United States Patent [19]

Calvert

[11] 4,236,419

[45] Dec. 2, 1980

[54] CLOTHES HOIST ELEVATING MEANS

[75] Inventor: Ronald J. Calvert, Edwardstown, Australia

[73] Assignee: Hills Industries Limited, Edwardstown, Australia

[21] Appl. No.: 859,588

[22] Filed: Dec. 12, 1977

[30] Foreign Application Priority Data

Dec. 15, 1976 [AU] Australia ..... PC8497

[51] Int. Cl.[3] ..... F16H 27/02

[52] U.S. Cl. ..... 74/89.15; 74/424.8 R

[58] Field of Search ..... 74/89.15, 424.7, 424.8 R, 74/425; 251/229; 211/119.17, 196, 197; 248/405; 85/80, 5 R; 24/274 R, 208, 73 P, 73 PF

[56] References Cited

U.S. PATENT DOCUMENTS

| | | | |
|---|---|---|---|
| 2,090,330 | 8/1937 | Jones | 74/424.8 R |
| 3,052,421 | 9/1962 | Fischer | 188/83 |
| 3,620,494 | 11/1971 | Gastow | 74/424.8 R |
| 3,798,984 | 3/1974 | McMinn | 74/89.15 |
| 3,824,905 | 7/1974 | Jablonsky | 74/89.15 |
| 3,905,570 | 9/1975 | Nieuwveld | 85/5 R |

*Primary Examiner*—Samuel Scott
*Assistant Examiner*—G. Anderson
*Attorney, Agent, or Firm*—Norbert P. Holler

[57] ABSTRACT

In a clothes hoist the fixed lower standard contains an aperture over which is secured a cover containing a bearing in which a driven shaft is journalled. The shaft has a handle on its outer end and a driving pinion on its inner end which meshes with a toothed nut supported by an abutment block within the fixed lower standard. The toothed nut threadably engages the worm which supports the lower end of the elevating standard such that rotation of the handle raises the worm in turn raising the standard.

8 Claims, 5 Drawing Figures

CLOTHES HOIST ELEVATING MEANS

This invention relates to elevating means for raising the elevating standard, of a clothes hoist.

BACKGROUND OF THE INVENTION

The usual existing clothes hoist, and the type to which this invention relates, is provided with a fixed lower standard, an elevating standard which may rotate, and an operating handle projecting from one side of the fixed lower standard.

The previously made and used clothes hoists of this type utilised a gear box which divided the lower standard into two portions, the gear box containing a bearing in which was housed a shaft, the shaft having a handle at its outer end for effecting rotation thereof, and its inner end being keyed to a bevel pinion. The housing previously contained a freely rotating nut which was restrained by the housing against vertical movement and which threadably engaged a worm. The worm extended upwardly to support the elevating standard housing at its lower end, and rotation of the handle in turn caused the nut to rotate on the worm and raise or lower the worm.

The main object of this invention is to provide improvements in clothes hoists of this general type, and particularly improvements in the elevating means, whereby a clothes hoist can be made more pleasing aesthetically and the costs of the mechanism can be reduced without sacrifice of quality.

BRIEF SUMMARY OF THE INVENTION

Briefly, in this invention, the fixed lower standard of a clothes hoist has an aperture through its wall, and a cover over the aperture contains a bearing in which a drive shaft is journalled. The outer end of the drive shaft carries a handle, and the inner end a driving pinion which meshes with a toothed nut supported by an abutment block within the lower fixed housing. The toothed nut threadably engages a worm, which supports the lower end of the elevating standard, so the rotation of the handle raises the worm and thereby raises the elevating handle.

More specifically, in this invention elevating means comprise:

an abutment block in the fixed lower standard, said abutment block having surfaces defining a non-circular aperture extending through it, a toothed nut supported by the abutment block, an aperture extending through the wall of the fixed lower standard, adjacent but above the toothed nut, a cover secured to said wall over said aperture, a bearing in the cover, a driving shaft journalled for rotation in the bearing, a handle on the outer end and a pinion on the inner end of the driving shaft, said pinion meshing with said toothed nut, a worm extending through said abutment block, said worm having faces engaging said non-circular surfaces of the abutment block aperture so as to inhibit rotation of the worm, and means on the upper end of the worm supporting said upper elevating standard, said worm being threadably engaged by said toothed nut such that rotation of such toothed nut causes raising of the worm and thereby raising of the upper elevating standard.

With this invention it is not necessary for use to be made of a separate gear box, and the relatively inexpensive cover is simply secured to the outer wall of the fixed lower standard. It does not divide the lower standard into two portions, as in the case of a gearbox.

The invention has other aspects, and to avoid inadvertent lowering of the elevating standard, in one other aspect there is provided a brake ring between the toothed nut and abutment block to increase friction between them. In another aspect, the attachment means between the worm and the elevating standard comprises a dish shaped plug having a central aperture therein at the lower end of the elevating standard, and a tapered bifurcate head on the top of the worm passes through the plug aperture, the head having an abutment surface at its lower end which limits the possibility of inadvertent release of the elevating standard from the worm by abutment with the aperture plate.

BRIEF DESCRIPTION OF THE DRAWINGS

An embodiment of the invention is described hereunder in some detail with reference to and is illustrated in the accompanying drawings, in which.

DETAILED DESCRIPTION OF THE DRAWINGS

Figure 1:
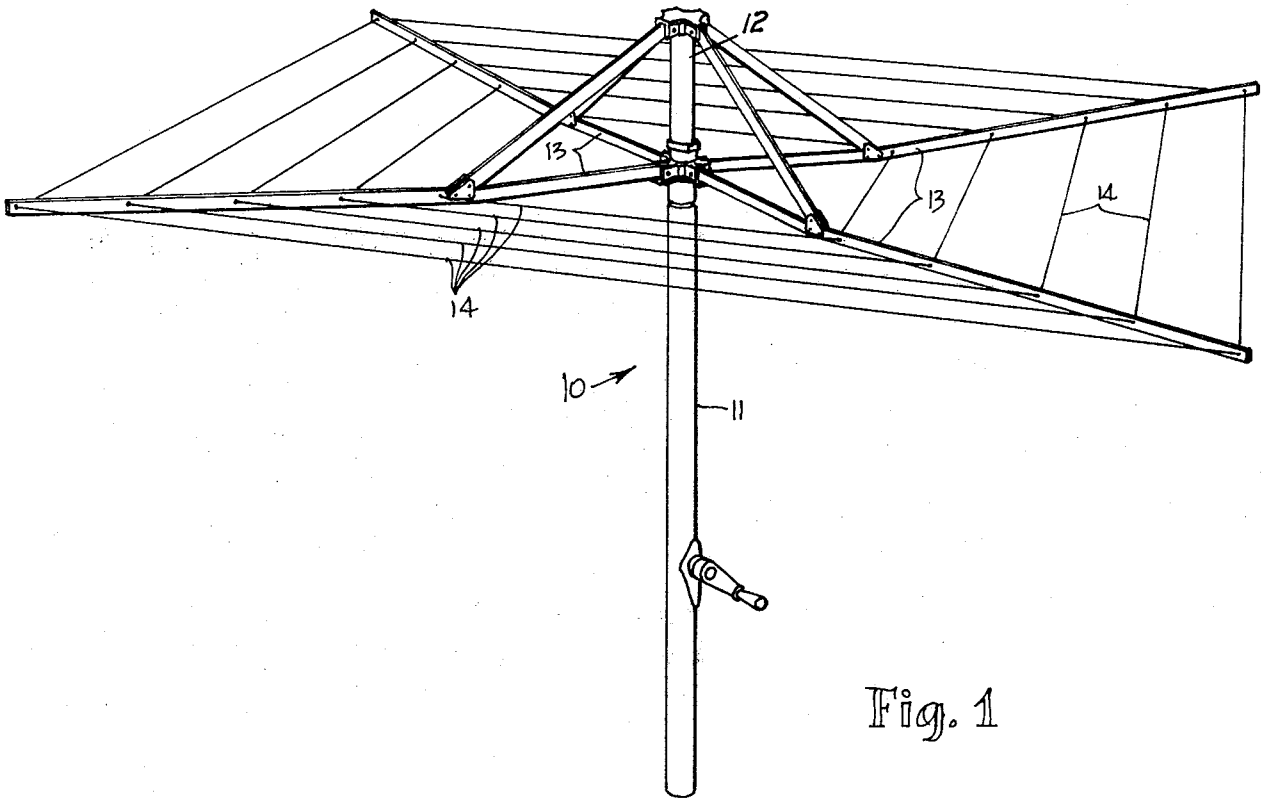
FIG. 1 is a perspective view of a clothes hoist which embodies the invention.
Figure 2:
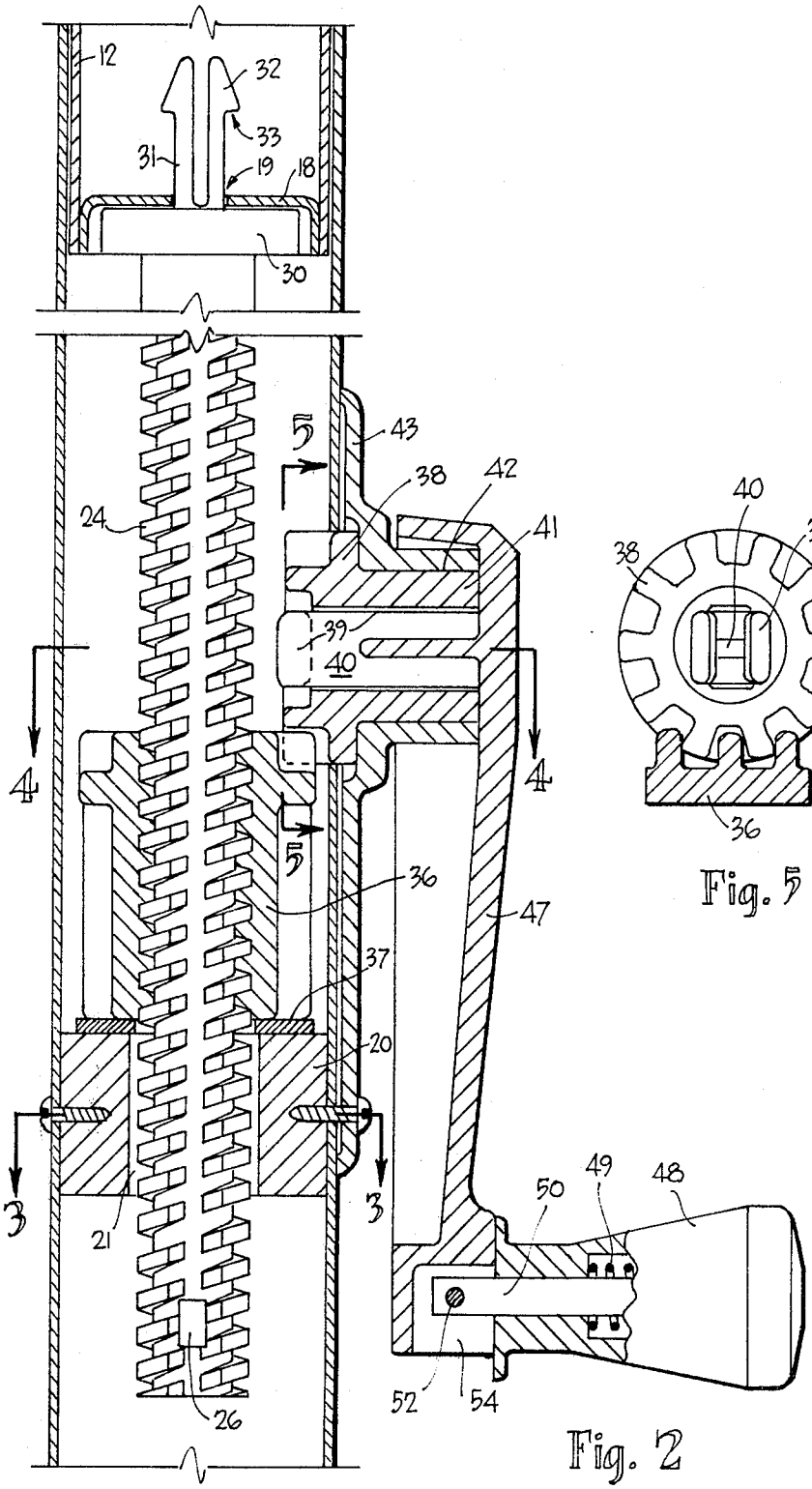
FIG. 2 is a fragmentary elevational section through portion of the fixed lower standard, drawn to an enlarged scale.
Figure 5:
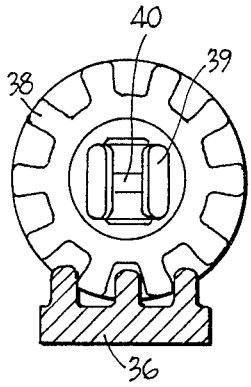
FIG. 5 is a cross-section showing the gear arrangement, taken on line 5—5 of FIG. 2.

In this embodiment a rotary clothes hoist 10 is provided with a fixed lower standard 11 of tubular metal and an elevating standard 12 telescopically slidable therein, also of tubular metal, the elevating standard 12 having radiating arms 13 pivoted thereto between which are strung a plurality of clothes lines 14.

The lower end of the elevating standard 12 is provided with an apertured plug 18 of shallow dish formation press fitted thereinto, the apertured plug 18 having a central aperture 19 therein.

Figure 3:
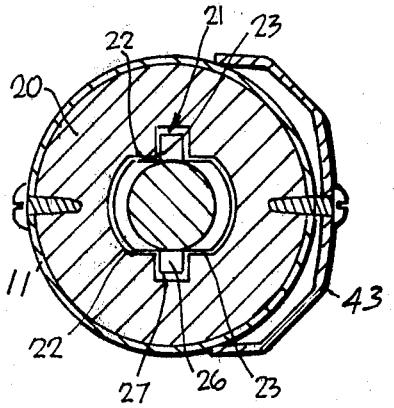
FIG. 3 is a cross-section taken on line 33 of FIG. 2.

Within the fixed standard and positioned below the lower end of the elevating standard 12 when in its lowest position there is secured an abutment block 20, the abutment block 20 containing two intersecting slots at right angles to one another the walls of which define a cruciform aperture 21 extending therethrough (FIG. 3). One slot however is larger than the other, and the largest slot has parallel sides 22 which are engaged by complementary parallel sides 23 of a worm 24, the arrangement thereby being such that rotation of the worm is inhibited, although the worm is free to slide through block 20. The lower end of the worm 24 contains a limit peg 26 extending therethrough, and projecting from the two parallel sides and this is movable through the smaller of the two slots (designated 27) in the abutment block 20.

The upper end of the worm 24 is provided with an outstanding flange 30, and the outstanding flange merges into a central upstanding stem 31 which is bifurcate and which terminates at its upper end in a tapered head 32 which diverges downwardly and terminates in an abutment surface 33. The arrangement is such that the head can be driven through the aperture 19 of the apertured plug 18 and returns to its normal shape whereupon release is prevented by abutment of the abutment surface 33 of the head with the upper surface of the apertured plug 18.

The lower fixed standard carries in it a toothed nut 36 which threadably engages the worm 24 and rotates about the longitudinal or polar axis of the lower standard 11. The toothed nut rests upon the abutment block 20 but has interposed therebetween a brake ring 37 having friction characteristics which will limit the tendency for the elevating standard to cause rotation of the toothed nut and consequential spinning of the handle, for example under conditions of high wind. The nut 36 also prevents upward withdrawal of the worm 24, since its lower surface is engaged by peg 26.

Figure 4:
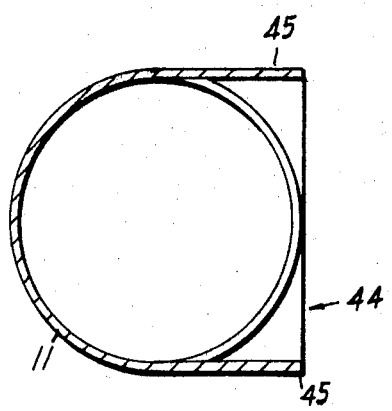
FIG. 4 is a crosssection through the fixed lower standard only, taken on line 4—4 of FIG. 2.

The toothed nut 36 is engaged by a toothed pinion 38 having an axis of rotation at right angles thereto, the toothed pinion 38 having a square aperture 39 which provides key means for keying to a square bifurcate shank 40 on a handle spindle 41, the handle spindle non-rotationally coupled to the toothed pinion 38. The handle spindle 41 in this embodiment is a skirt of the pinion 38 which is journalled in a bearing surface 42 of a cover 43 which covers an aperture 44 formed in the side wall of the fixed lower standard 11. The combination of handle spindle 41 and skirt therefore form a driving shaft, having a handle 47 at one end and the toothed pinion 38 at the other. The aperture is cut into the fixed lower standard, but the surround is expanded to form flanges 45 (FIG. 4) so as to reduce loss of stiffness of the lower fixed standard. The cover 43 is rigidly secured to the outer surface of the fixed lower standard for the same reason.

The handle arm 47 is keyed to the outer end of the handle spindle 41, and the swinging end of the handle arm has a handle 48 pivoted thereto, the handle containing a spring 49 bearing between a surface of the handle and the end of a plunger 50, urging the handle towards the handle arm 47. A pivot pin 52 extends through the outer end of the handle arm and through the plunger 50 to allow the handle to be moved between an operative position (as shown) and the spring tends to maintain the handle in the position which it occupies, the swinging end of the handle arm 47 having two flat surfaces 53 and 54 for this purpose.

A consideration of the above embodiment will indicate the invention is very simple. It makes possible the use of worm, nut, pinion and abutment blocks all to be formed from plastics material so that costs can be substantially reduced. However good engineering principles can be incorporated, and for example the buckling strength of the lower fixed standard is not impaired as in some instances, where the lower fixed standard is in two portions separated by a gear box.

Various modifications in structure and/or function may be made by one skilled in the art without departing from the scope of the invention as recited in the claims.

What is claimed is:

1. Elevating means for raising the elevating standard of a clothes hoist having a fixed lower standard and an upper elevating standard, comprising:

an abutment block in the fixed lower standard, said abutment block having slot surfaces including a pair of diametrically opposite parallel surfaces defining a non-circular slot extending through it, a toothed nut of smaller diameter than the lower standard, contained within the lower standard for rotation about the polar axis of the lower standard, and supported by the abutment block, the lower standard being a continuous tubular member but having an aperture extending through the wall thereof, adjacent but above the toothed nut, a cover secured to said wall over said aperture, a bearing in the cover, a driving shaft journalled for rotation in the bearing about an axis at right angles to the polar axis of the lower standard, a handle on the outer end and a pinion on the inner end of the driving shaft, said pinion meshing with said toothed nut, a worm extending through said abutment block, said worm having a pair of diametrically opposite parallel faces engaging said parallel surfaces of the abutment block slot so as to inhibit rotation of the worm, and means on the upper end of the worm supporting said upper elevating standard, said worm being threadably engaged by said toothed nut such that rotation of said toothed nut causes raising of the worm and thereby raising of the upper elevating standard.

2. Elevating means according to claim 1 further comprising a brake ring between the toothed nut and the abutment block.

3. Elevating means according to claim 1 further comprising a plug in the lower end of the upper elevating standard, an aperture extending through the plug, a bifurcate stem on the upper end of the worm extending through the aperture, the bifurcate stem having a tapered head with an abutment surface thereon, the tapered head being insertable through the aperture by resilient deformation of the stem but the abutment surface being arranged to engage a surface of the plug and thereby prevent upward withdrawal of the upper elevating standard from the worm.

4. Elevating means according to claim 1 further comprising a limit peg extending through and projecting from said worm near its lower end and arranged to engage a lower surface of said nut and thereby prevent upward withdrawal of the worm from the fixed lower standard.

5. Elevating means according to claim 4 wherein said non-circular slot surfaces of the abutment block define a cruciform shape in plan, said worm having opposite side faces which slidably engage one pair of opposite said aperture surfaces, the other pair of opposite said aperture surfaces defining a slot through which said limit peg is freely movable.

6. Elevating means according to claim 1 wherein said driving shaft comprises a bifurcate square section shank portion having a retaining head thereon, and the pinion contains a square section aperture the walls of which are engaged by said square section shank portion, said square section shank portion retaining head having a surface which retains the pinion thereto.

7. Elevating means according to claim 1 wherein the fixed lower standard comprises a pair of spaced parallel flanges flanking said aperture extending through the wall thereof, the flanges extending in the general direction of the longitudinal axis of the lower standard and imparting stiffness at the locality of said aperture extending therethrough.

8. Elevating means according to claim 1 further comprising fasteners securing said cover to said fixed lower standard to be contiguous with portion of its outer surface.

* * * * *